US005322184A

United States Patent [19]

Bergner et al.

[11] Patent Number: 5,322,184

[45] Date of Patent: Jun. 21, 1994

[54] PACKAGE FOR POURABLE SUBSTANCES

[75] Inventors: Rainer Bergner, Duesseldorf; Hubert Droessler, Erkrath; Sieqfried Konkel, Duesseldorf; Volker Weiss, Langenfeld; Paul-Otto Weltgen, Hilden, all of Fed. Rep. of Germany

[73] Assignee: Henkel Kommanditgesellschaft auf Aktien, Duesseldorf, Fed. Rep. of Germany

[21] Appl. No.: 893,598

[22] Filed: Jun. 2, 1992

Related U.S. Application Data

[63] Continuation-in-part of Ser. No. 778,826 filed as PCT/EP90/00981, Jun. 21, 1990, abandoned.

[30] Foreign Application Priority Data

Jun. 29, 1989 [DE] Fed. Rep. of Germany ..... 3921258

[51] Int. Cl.[5] ..... B65D 23/08

[52] U.S. Cl. ..... 220/771; 220/770; 220/756; 220/739; 215/12.2; 215/100 A

[58] Field of Search ..... 215/12.1, 12.2, 1 C, 215/DIG. 6, 100 A, 31; 222/465.1, 466; 229/90, 87.04; 220/771, 753, 756, 759, 770, 741, 739, 737, 662, 400

[56] References Cited

U.S. PATENT DOCUMENTS

| | | | |
|---|---|---|---|
| 228,002 | 5/1880 | Swope | 229/90 |
| 1,034,762 | 8/1912 | Brown | 229/90 |
| 2,936,927 | 5/1960 | Peters | 222/465.1 |
| 3,160,326 | 12/1964 | Sturdevant et al. | 222/183 |
| 3,205,764 | 9/1965 | Letter | 220/662 |
| 3,567,104 | 3/1971 | Arsianian et al. | 229/14 |
| 4,368,827 | 1/1983 | Thompson | 215/100 |
| 4,671,452 | 6/1987 | Pupp et al. | 222/465.1 |
| 5,122,399 | 6/1992 | Farrell et al. | 215/12.2 |
| 5,147,067 | 9/1992 | Effertz | 229/87.04 |
| 5,165,557 | 11/1992 | Ota et al. | 220/771 |

FOREIGN PATENT DOCUMENTS

| | | |
|---|---|---|
| 0225677 | 6/1987 | European Pat. Off. . |
| 2013654 | 4/1970 | France . |
| 2162153 | 1/1986 | United Kingdom . |
| 2206567 | 1/1989 | United Kingdom . |

*Primary Examiner*—Stephen P. Garbe
*Assistant Examiner*—S. Castellano
*Attorney, Agent, or Firm*—Ernest G. Szoke; Wayne C. Jaeschke; Kenneth Watov

[57] ABSTRACT

A package for pourable substances like liquids or loose fine granulates includes an inner plastic container holding the substance to be packed and a cardboard envelop surrounding the plastic container, wherein the plastic container is a thin-walled hollow plastic body made by a blowing process. The envelope, when set up as a package, is at least locally in contact with the plastic container and is fitted with apertures facilitating its holding the plastic container. The hollow plastic body has at least two straight surfaces substantially forming one edge, in which a region of the associated side has a recess, and apertures in the cardboard envelope formed as a supporting case correspond to the recess in the edge region of the hollow plastic body to provide a handle.

30 Claims, 6 Drawing Sheets

PACKAGE FOR POURABLE SUBSTANCES

This application is a continuation-in-part of Ser. No. 07/778,826, filed Feb. 19, 1992, now abandoned, which is the national stage of PCT/EP 90/00981 filed on Jun. 21, 1990.

BACKGROUND

1. Field of the Invention

This invention relates generally to containers, and more particularly to a pack for pourable materials.

2. Discussion of Related Art

There are a number of known packs consisting of at least two elements, namely an inner plastic container or bag and an outer envelope of cardboard, for example of the type described in GB-A-944,565 or DE-A-29 03 562. If the inner plastic container has little or no stability, the cardboard envelope is generally used to stiffen the pack, although it is also intended to enable printing or the like to be applied more easily. A pack of this type is also known, for example, from EP-O 225 677-A2.

In view of the increase in environmental awareness, efforts are being made to reduce the plastic component of packs and to increase the paper or cardboard envelope component because the necessary material can be obtained by recycling wastepaper. Efforts are also being made to guarantee the refillability of such packs without affecting any of the key functions of stability, ease of handling and the like.

A pack shown in FR-A-2 013 654 consists of a hollow plastic container which is produced by blow-molding, and of which the supporting jacket is fixed on the hollow plastic container through the presence in the supporting jacket of several openings which engage with corresponding projections on the hollow plastic container. The disadvantage of the round pack described is that, the supporting jacket and the hollow plastic container have to be specifically guided towards one another or have to be turned relative to one another until the openings in the supporting jacket and the projections on the hollow plastic container engage in one another. This necessitates particular effort in the production of the pack. In addition, the plurality of interengaging fixing elements complicates separation of the hollow plastic container and the supporting jacket, whereby considerable force is required for removing the supporting jacket from the hollow plastic container. In another embodiment of this known pack, the supporting jacket is fixed in a groove formed in the hollow plastic container. Considerable force again has to be applied to separate the supporting jacket and the hollow plastic container. Finally, the known packs have no grip openings or grips for handling the pack.

U.S. Pat. No. 3,160,326 describes a pack consisting of a hollow plastic container and a surrounding envelope of cardboard. However, this envelope is not a supporting jacket, but rather an outer cardboard case provided with base and cover laps. This outer cardboard case comprises laps designed to be folded inwards into a recess formed in the hollow plastic container. Grip openings are formed in this way. In this known pack, the outer envelope is not fixed on the hollow plastic container by the laps, but by cover and base laps instead.

GB-A-2,206,567 describes a thin-walled hollow plastic container which is provided with a reinforcing shoulder in the vicinity of this closure.

A bottle surrounded by an envelope is known from DE-C-193 757, the envelope being locally provided with die-cut openings for checking the filling level of the bottle.

Finally, U.S. Pat. No. 4,368,827 describes a hollow plastic container which, along one side edge, is formed with a recess in the form of a handle for holding the container.

SUMMARY OF THE INVENTION

The problem addressed by the present invention was to provide a solution with which all the handling advantages would remain intact in a pack of the type mentioned above, while at the same time, minimizing the amount of plastic and cardboard used in the pack. In addition, an object of the invention is both to provide easy separation of the hollow plastic container and the supporting jacket, while fixing the supporting jacket firmly on the hollow plastic container.

In addition to the production advantages of such hollow plastic containers, another object of the invention is to provide for convenient handling through the handle opening in both the supporting jacket, and the corresponding recess in the container. Yet another object is to insure the two elements can be separated comparatively easily from one another for reprocessing of the raw materials.

Because in one embodiment of the invention a handle is not formed on the hollow plastic container itself, plastic material is also saved. The supporting jacket may be in the form of a cardboard jacket open at both ends to save material. A plastic bottle formed with gripping means along one edge is known from U.S. Pat. No. 4,368,827.

In another embodiment of the invention, the supporting jacket surfaces of the cardboard envelope corresponding to the recess in the hollow plastic container are in the form of inwardly foldable die-cuttings designed to form a handle in the envelope only.

Although a handle design according to the invention would also be applicable to packs of round cross-section, the problem would be technically easier to solve if the handle could be formed in the region of at least two abutting straight surfaces. Accordingly, it is best to make the cross-section of the pack rectangular, square or polygonal so that at least one edge suitable for a handle opening is formed. In another embodiment of the invention, therefore, the hollow plastic container is provided with at least two straight surfaces substantially forming an edge, a recess being formed in the edge region of these surfaces, and the inwardly foldable laps of the envelope forming a handle with grip openings by which the pack can be held. In another embodiment of the invention, the plastic container and the supporting jacket are of substantially rectangular or square cross-section in the handling position.

In a further embodiment of the invention, the glueing lap of the supporting jacket is positioned in the corner edge region which, in the in-use position, is used to form the handle, so that the wall is reinforced by simple means, i.e. by a two-ply structure.

Another embodiment of the invention provides in the handling position, that the hollow plastic container and the supporting jacket are of substantially rectangular or square cross-section and recesses are formed in opposite straight surfaces of the hollow plastic container.

In another, preferred embodiment of the invention, at least one fixing projection is provided in the recess of the hollow plastic container for additionally fixing the laps so that the fold does not have to be glued. A fixed unit is thus formed between the inner plastic container and the supporting jacket without complicating separation of the different materials after the packs have been used. The separate disposal of the supporting jacket and the plastic container is thus guaranteed because the two parts are easy to separate.

In order to simplify the possibilities of manipulation, including inter alia the machine filling and machine closure of the pack, another embodiment of the invention provides the plastic container in the vicinity of the closure with a reinforcing shoulder comprising at least two opposite, straight contact surfaces and, more particularly, is of square, hexagonal, octagonal or the like cross-section.

In another embodiment of the invention, the plastic container is provided with reinforcing webs and/or locally with outwardly facing fixing ribs while the supporting jacket is provided with die-cut parts in which the fixing ribs engage.

The die-cut openings in the supporting jacket may also be used to check the filling level inside the plastic container. According to the invention, the supporting jacket is locally die-cut to form openings for checking the filling level of the plastic container.

In addition, to increase stability, at least parts of the free lower edges of the supporting jacket are provided with inwardly foldable reinforcing laps. High stability can also be achieved by reinforcing the base of the plastic container. If the surrounding supporting jacket is made slightly shorter than the supporting wall surface of the plastic container, the entry of moisture from the area around the base into the supporting jacket of cardboard can be at least partly avoided.

BRIEF DESCRIPTION OF THE DRAWINGS

The invention is described in more detail below with reference to the accompanying drawings, in which like items have the same reference designation, wherein: in the in-use position, is used to form the handle so that the walls are reinforced in a simple manner by the two-ply structure.

The invention is described in more detail in the following with reference to the accompanying drawings, wherein.

DETAILED DESCRIPTION OF THE INVENTION

In the illustrated embodiment, the pack generally denoted by the reference 1 consists of a hollow plastic container 2 of substantially square cross-section, a supporting jacket 3 of cardboard or a comparable material.

Figure 1:
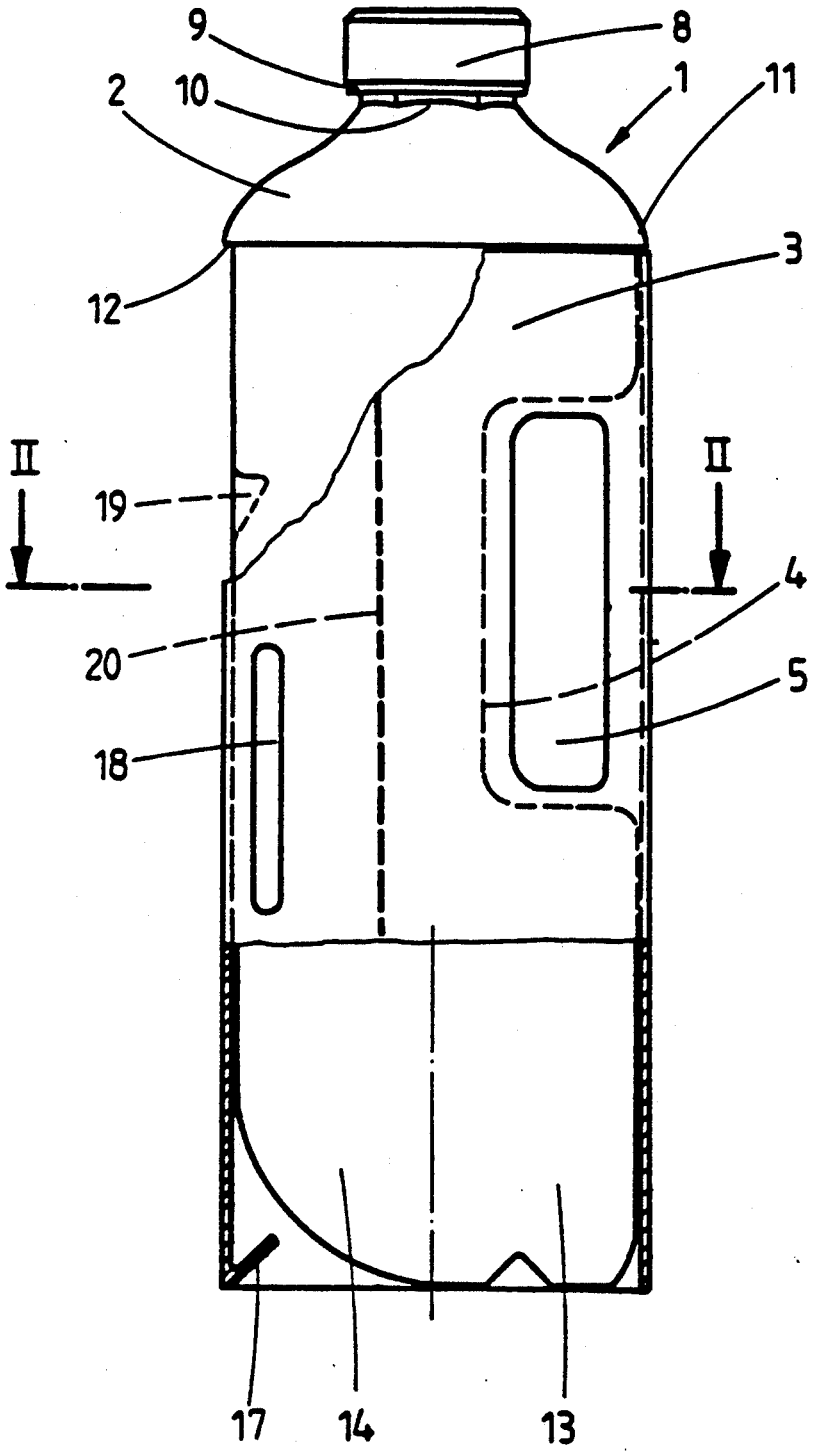
FIG. 1 is a side elevational view of the pack with the jacket partly broken open for one embodiment of the invention.

In one corner, the plastic container 2 is provided with a recess denoted by the reference 4 which is shown in chain lines in FIG. 1. Conversely, the supporting jacket 3 has two handle openings 5 in this region, the corner denoted by the reference 6 having a multilayer structure so that parts of the die-cut laps—denoted by the reference 7 in FIG. 2—are folded inwards and fixed in position. The corner 6 itself may also be provided with the glueing lap of the supporting jacket 3 although this has not been shown.

In the region of the closure 8, the plastic container 2 has an upper encircling supporting shoulder 9 and contact surfaces 10 which, in the illustrated embodiment, are hexagonal. The plastic container 2 also has an upper supporting shoulder 11 which, in the in-use position, rests on the free edge 12 of the encircling supporting jacket 3.

FIG. 1 shows two different designs for the base of the plastic container 2. One design is with reinforcing webs 13 (bottom right). The other design shows the base of the container being shaped like a spherical sector, as denoted by the reference 14 on the left of FIG. 1.

Figure 2:
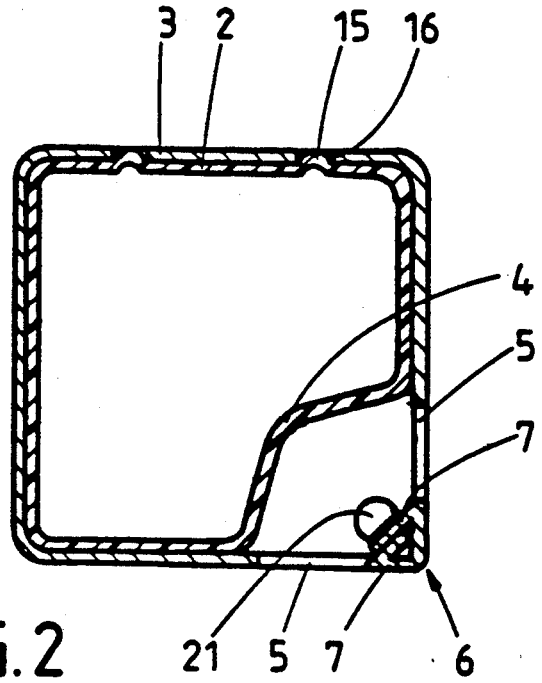
FIG. 2 is a section on the line II—II in FIG. 1.

In addition to the illustrated handle opening design, which also serves to hold the plastic container 2 in the supporting jacket 3, the hollow plastic container may also be provided with outwardly acing ribs 15 and the supporting jacket with corresponding die-cut openings 16, as shown at the top of FIG. 2. In addition, the lower free edge of the supporting jacket 3 may be folded inwards, the corresponding laps being denoted by the reference 17 in FIG. 1. Further die-cut openings 18 may be provided, for example to enable the filling level to be monitored.

Instead of the outwardly facing ribs 15 with corresponding die-cut openings 16, inwardly facing spaces may also be provided in the container 2 so that the supporting jacket 3 can be folded inwards, as denoted by the reference 19 in FIG. 1. A fixing system such as this is particularly useful when no handle openings are provided. In addition, the supporting jacket 3 may be provided with a tear thread 20 to make the supporting jacket 3 easier to remove.

FIG. 2 illustrates the possibility of providing fixing projections 21 on the plastic container which fix the laps 7 after they have been folded to eliminate the need for glueing.

Figure 3:
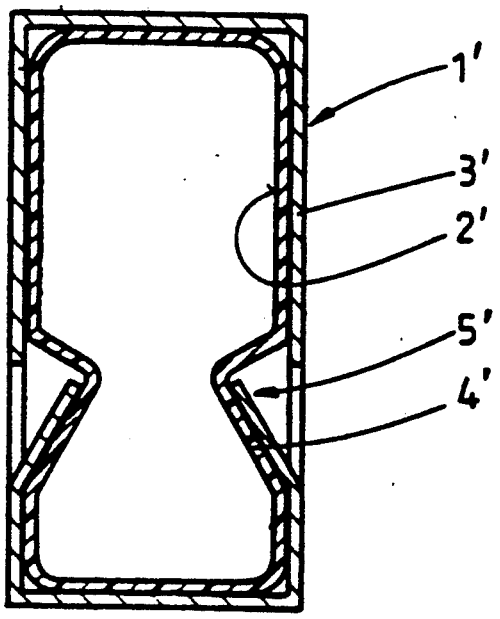
FIG. 3 is a section through a modified embodiment of the pack according to the invention.

FIG. 3 shows a modified embodiment of the invention in which the same elements are denoted by the same reference numerals as in FIGS. 1 and 2 accompanied by an apostrophe.

In this modified embodiment, the plastic container 2' is only provided with handle depressions 4' in which the laps 5' engage to make the pack easier to handle and to fix the supporting jacket 3'.

A fixing system useful when no handle openings are provided is briefly described above for one embodiment of the invention. In a preferred embodiment for a handleless pack, reference is now made to FIGS. 4 through 7.

Figure 4:
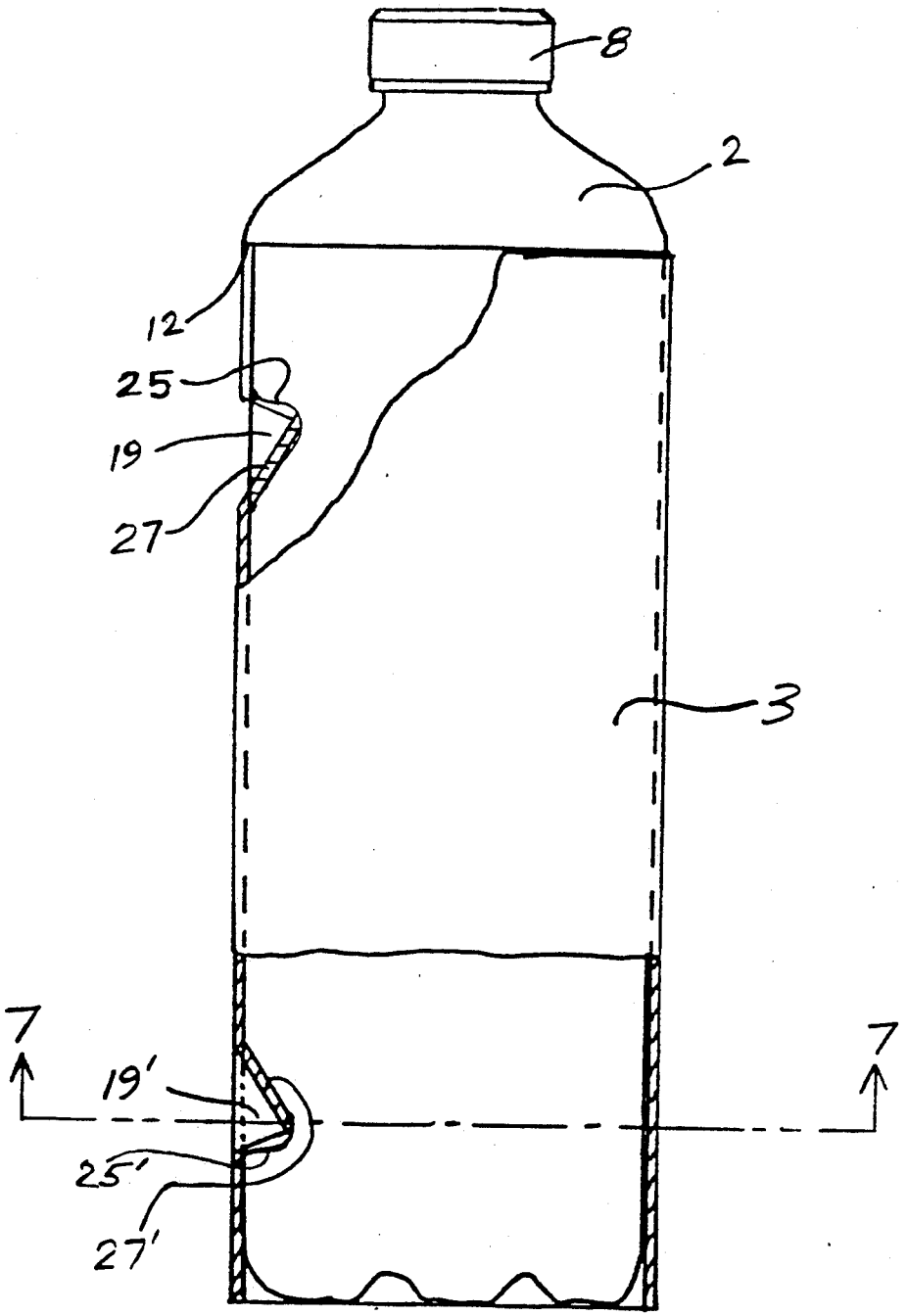
FIG. 4 is a side elevational view of the present pack partially cutaway in selected portions for showing features of another embodiment of the invention.
Figure 5:
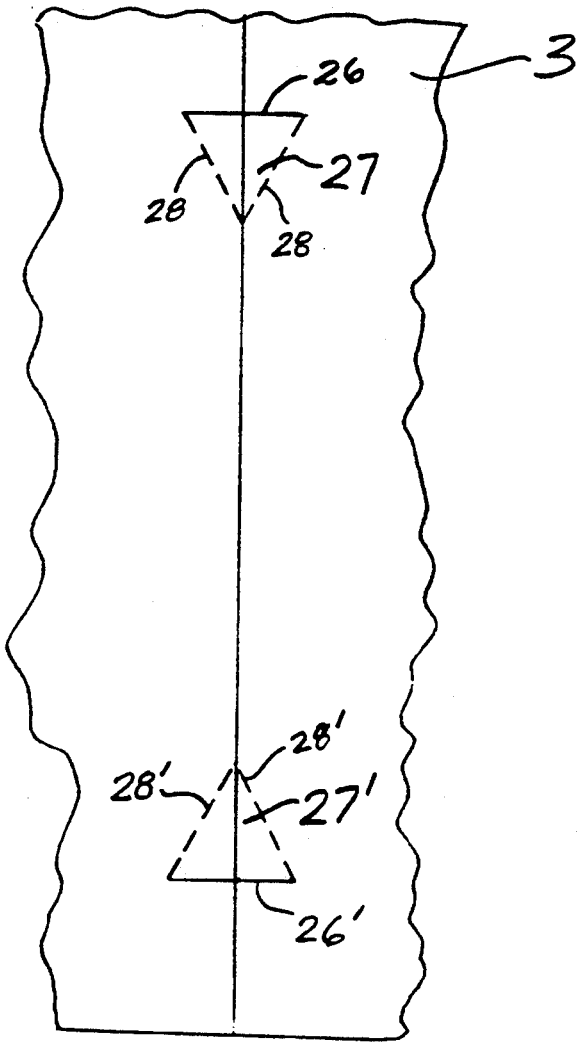
FIG. 5 is an elevational view of a portion of the left edge of the exterior of the pack of FIG. 4, showing features of the exterior jacket thereof.
Figure 6:
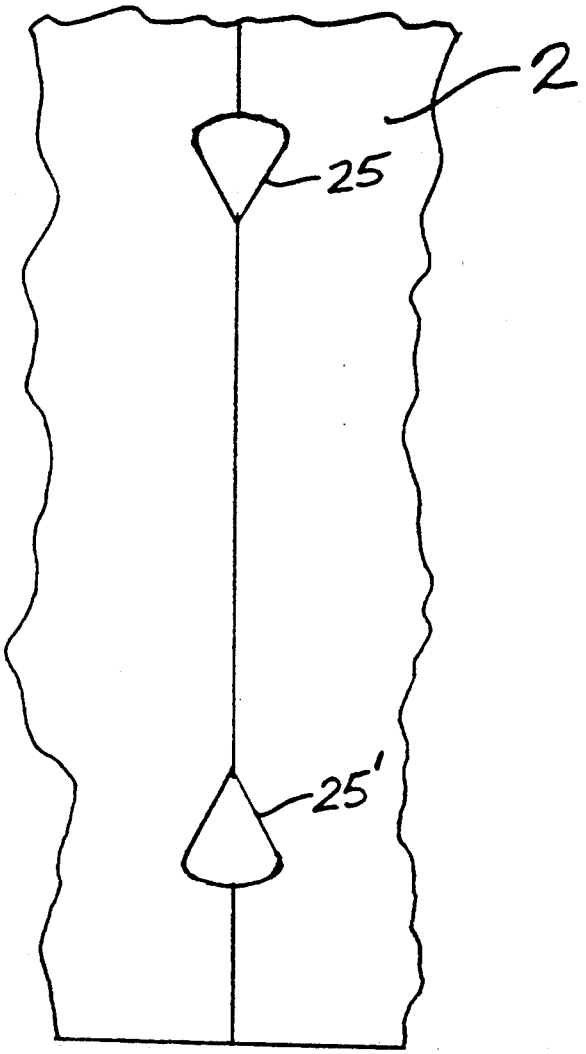
FIG. 6 is an elevational view of a portion of the left edge of a plastic container underlying or covered by the exterior jacket of FIG. 5.
Figure 7:
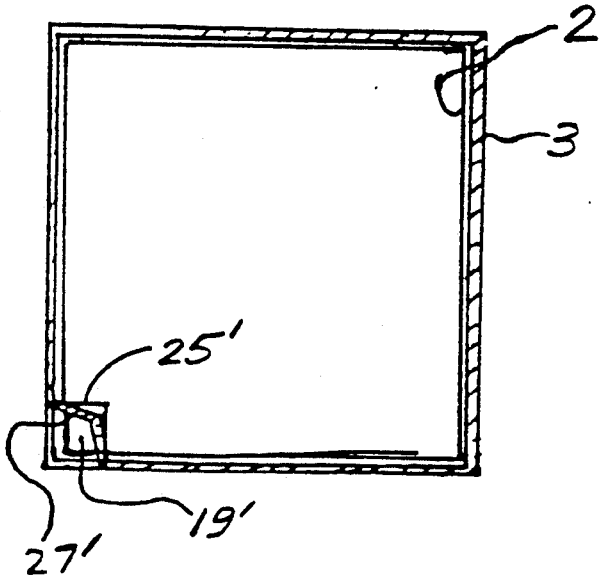
FIG. 7 is a cross-sectional view along 7—7 of FIG. 4.

In FIG. 4, lap locking portions 19 and 19' are formed in upper and lower portions, respectively, along one edge of a jacket 3 overlying a container 2, in this example. With further reference to FIGS. 5 through 7, in this example, the outer jacket 3 includes along the associated edge two triangularly shaped fold in latches 27,27'. Latch 27 has a cut through upper side 26, and two other die scored sides 28, whereas latch 27' has a cut through lower side 26', and two die scored sides 28'. This design permits a user to press or fold the latches 27 and 27' inward to be received by and interlocked into downwardly and upwardly projecting tear drop shaped recesses 25 and 25', respectively, formed along an associated edge of container 2, as shown. FIG. 7 is a cross-sectional view showing latch 27' interlocked into recess 25', for providing lap 19'. In this manner, jacket 3 and container 2 are secured to one another. In certain applications, only one lap 19 or 19' may be required, in other applications, more than two such laps or interlocking means may be used to interlock container 2 to envelope 3.

The described embodiments of the invention may be modified in various respects by those of skill in the art without departing from the basic scope of the invention. For example, the supporting jacket 3 may if necessary comprise several layers; the closure may be provided elsewhere on the plastic container, and so forth. Instead of the fixing projections 21, ribbed or friction-increased surfaces may be provided on the plastic container. The materials mentioned for the supporting jacket may of course be replaced by sheet metals or plastics.

These and other modifications are meant to be covered by the spirit and scope of the appended claims.

We claim:

1. A pack for containing a pourable material, comprises an inner hollow plastic container for the material to be packed, and a cardboard envelope which surrounds the hollow plastic container and which is in contact therewith in the in-use position of the pack, said hollow plastic container being produced by blow molding and being formed with an upper supporting shoulder, said envelope being in the form of a base and lid-free supporting jacket with an upper contact edge by which it is supported on the supporting shoulder, wherein said hollow plastic container is of thin-walled construction and has at least one recess receiving laps of said supporting jacket fixing said supporting jacket on the hollow plastic container, and for providing easy separation of said container from said cardboard envelope, whereby handle openings are formed when said laps are folded into said recesses, respectively, and wherein at least one fixing projection is provided in the recess of the hollow plastic container additionally fixing the laps.

2. A pack as claimed in claim 1, wherein said hollow plastic container is provided with at least two straight surfaces substantially forming an edge, a recess being formed in the edge region of one of these surfaces and inwardly foldable laps of said envelope form a handle with grip openings by which the pack can be held.

3. A pack as claimed in claim 2, wherein said plastic container and the supporting jacket are of substantially rectangular cross-section in the handling position.

4. A pack as claimed in claim 2, further including a glueing lap of said supporting jacket positioned in a corner edge region which, in the in-use position, is used to form a handle.

5. A pack as claimed in claim 1, wherein in the handling position, the hollow plastic container and the supporting jacket are of substantially rectangular cross-section and recesses are formed in opposite straight surfaces of the hollow plastic container.

6. A pack as claimed in claim 1, wherein in the vicinity of a closure, the plastic container is provided with a reinforcing shoulder having at least two opposite, straight contact surfaces of predetermined cross-section.

7. A pack as claimed in claim 1, wherein the plastic container is provided locally with outwardly facing ribs and the supporting jacket is provided with die-cut openings in which the ribs engage.

8. A pack as claimed in claim 1, wherein said supporting jacket is locally provided with die-cut openings for checking the filling level of the plastic container.

9. A pack as claimed in claim 1, wherein at least parts of free lower edges of said supporting jacket are provided with inwardly foldable reinforcing laps.

10. A pack as claimed in claim 3, further including a glueing lap of said supporting jacket positioned in a corner edge region which, in the in-use position, is used to form a handle.

11. A pack as claimed in claim 1, wherein in the vicinity of a closure, the plastic container is provided with a reinforcing shoulder having at least two opposite, straight contact surfaces of square cross-section.

12. A pack as claimed in claim 1, wherein in the vicinity of a closure, the plastic container is provided with a reinforcing shoulder having at least two opposite, straight contact surfaces of hexagonal cross-section.

13. A pack as claimed in claim 1, wherein in the vicinity of a closure, the plastic container is provided with a reinforcing shoulder having at least two opposite, straight contact surfaces of octagonal cross-section.

14. A pack as claimed in claim 2, wherein the plastic container is provided locally with outwardly facing ribs and the supporting jacket is provided with die-cut openings in which the ribs engage.

15. A pack as claimed in claim 3, wherein the plastic container is provided locally with outwardly facing ribs and the supporting jacket is provided with die-cut openings in which the ribs engage.

16. A pack as claimed in claim 4, wherein the plastic container is provided locally with outwardly facing ribs and the supporting jacket is provided with die-cut openings in which the ribs engage.

17. A pack as claimed in claim 2, wherein said supporting jacket is locally provided with die-cut openings for checking the filling level of the plastic container.

18. A pack as claimed in claim 3, wherein said supporting jacket is locally provided with die-cut openings for checking the filling level of the plastic container.

19. A pack as claimed in claim 2, wherein at least parts of free lower edges of said supporting jacket are provided with inwardly foldable reinforcing laps.

20. A pack for containing a pourable material comprises an inner hollow plastic container for the material to be packed, and a cardboard envelope surrounding the hollow plastic container and in contact therewith in an in-use position of the pack, said hollow plastic container being formed with an upper supporting shoulder, said envelope being in the form of a base and lid-free supporting jacket with an upper contact edge by which it is supported on the supporting shoulder, wherein said hollow plastic container is of thin-walled construction and has a first recess receiving a first lap of said supporting jacket fixing said supporting jacket on the hollow plastic container, and for facilitating the removal of said supporting jacket from said container by lifting said first lap out of said first recess, wherein said first lap has a triangular shape, with one side thereof being cut through, and two other sides thereof being partially scored, said first lap being pushed into an opposing said first recess of said container.

21. The pack of claim 20, wherein said recess of said container is tear drop shaped, and oriented on said container for receiving and captivating said lap to interlock said envelope to said container.

22. The pack of claim 20, wherein said lap is formed to be centralized along a side edge of said envelope, and said recess is formed to be centralized into a corresponding side edge of said container.

23. The pack of claim 20, further including a second lap in said envelope for folding into a second recess formed into a side portion of said container.

24. The pack of claim 23, further including:

said first and second laps each having a triangular shape and each being centralized along a side edge of said envelope;

said first lap being formed relative to said second lap closer to said upper shoulder of said container, and oriented with its cut through side being parallel to and proximate the horizontal plane of the shoulder of said container;

said second lap being formed close to the bottom of said container, and oriented with its cut through side being parallel to and proximate the bottom of said container; and said first and second recesses formed to be centralized along a corresponding side edge of said container, and positioned to be underlying said first and second laps, respectively, of said envelope.

25. The pack of claim 24, wherein said first and second recesses of said container each have a tear drop shape, and are oriented for latching or captivating the associated cut through sides of said first and second laps of said envelope, thereby preventing both removal of said envelope from said container, and limiting the longitudinal movement of said envelope upon said container.

26. A pack for containing a pourable material, comprising:

an inner hollow plastic container for the material to be packed;

a cardboard envelope surrounding the hollow plastic container and in contact therewith in an in-use position of the pack;

said hollow plastic container being formed with an upper supporting shoulder;

said envelope being in the form of a base and lid-free supporting jacket with an upper contact edge by which it is supported on the supporting shoulder;

said hollow plastic container being of thin-walled construction, and having a first recess receiving a first lap of said supporting jacket fixing said supporting jacket on the hollow plastic container, and for facilitating the removal of said supporting jacket from said container by lifting said first lap out of said first recess;

a second lap being included in said envelope for folding into a second recess formed into a side portion of said container;

said first and second laps each having a triangular shape and each being centralized along a side edge of said envelope;

said first lap being formed relative to said second lap closer to said upper shoulder of said container, and oriented with its cut through side being parallel to and proximate the horizontal plane of the shoulder of said container;

said second lap being formed close to the bottom of said container, and oriented with its cut through side being parallel to and proximate the bottom of said container; and said first and second recesses centralized along a corresponding side edge of said container, and underlying said first and second laps, respectively, of said envelope.

27. The pack of claim 26, wherein said first lap has a triangular shape, with one side thereof being cut through, and two other sides thereof being partially scored, for permitting said first lap to be pushed into an opposing said first recess of said container.

28. The pack of claim 27, wherein said recess of said container is tear drop shaped, and oriented on said container for receiving and captivating said first lap to interlock said envelope to said container.

29. The pack of claim 27, wherein said first lap is formed to be centralized along a side edge of said envelope, and said recess is formed to be centralized into a corresponding side edge of said container.

30. The pack of claim 27, wherein said first and second recesses of said container each have a tear drop shape, and are oriented for latching or captivating the associated cut through sides of said first and second laps of said envelope, thereby preventing both removal of said envelope from said container, and limiting the longitudinal movement of said envelope upon said container.

* * * * *

UNITED STATES PATENT AND TRADEMARK OFFICE

CERTIFICATE OF CORRECTION

PATENT NO. : 5,322,184

DATED : June 21, 1994

INVENTOR(S) : Bergner et. al.

It is certified that error appears in the above-indentified patent and that said Letters Patent is hereby corrected as shown below:

On the title page, item [75] Inventors:
The third inventor should read:
-- Siegfried Konkel --.

Signed and Sealed this

Ninth Day of May, 1995

Bruce Lehman

*Attest:*

BRUCE LEHMAN

*Attesting Officer*

*Commissioner of Patents and Trademarks*